United States Patent [19]

Dang

[11] Patent Number: 4,822,036

[45] Date of Patent: Apr. 18, 1989

[54] ISOKINETIC PHYSICAL EXERCISE APPARATUS WITH CONTROLLABLE MINIMUM RESISTANCE

[76] Inventor: Chi H. Dang, 3897 Birchwood Dr., Boulder, Colo. 80304

[21] Appl. No.: 185,392

[22] Filed: Apr. 25, 1988

[51] Int. Cl.[4] ..... A63B 21/24

[52] U.S. Cl. ..... 272/129; 272/125

[58] Field of Search ..... 272/125, 129

[56] References Cited

U.S. PATENT DOCUMENTS

| | | | |
|---|---|---|---|
| 3,848,467 | 11/1974 | Flavell | 272/129 X |
| 4,479,647 | 10/1984 | Smith | 272/129 X |
| 4,601,468 | 7/1986 | Bowd et al. | 272/129 X |
| 4,765,315 | 8/1988 | Krukowski | 272/125 X |

FOREIGN PATENT DOCUMENTS

| | | | |
|---|---|---|---|
| 3532444 | 3/1987 | Fed. Rep. of Germany | 272/129 |

*Primary Examiner*—Richard J. Apley
*Assistant Examiner*—Joe H. Cheng

[57] ABSTRACT

A resistance generator of a physical exercise apparatus generates a resistance that is the sum of two components: Isotonic and Isokinetic resistances; wherein the Isotonic is independent of motion speed and the Isokinetic increases with motion speed when the motion speed exceeds a preselected level. The Isokinetic component contains the user's exercise motion to an optimum speed range and provides resistance up to the user's maximum capacity. The Iostonic component insures a minimum resistance throughout the range of motion.

3 Claims, 8 Drawing Sheets

ISOKINETIC PHYSICAL EXERCISE APPARATUS WITH CONTROLLABLE MINIMUM RESISTANCE

BACKGROUND OF THE INVENTION

The present invention relates to physical exercise equipment, in particular to a novel apparatus for strength training.

Many studies indicate that the isokinetic strength training technique which requires movement at constant speed and at peak force throughout the full range of motion is the most effective for building strength and muscle mass. Hydraulic cylinders are commonly used in this type of exercise equipment; since its generated resistance increases with increasing speed, it can provide to the user the resistance up to his maximum capacity and limit his motion to the speed determined by his peak force. An electric generator having an electrical resistive load connected across its two output terminals can also be used as a means for generating resistance in isokinetic exercise equipments. When the rotation speed increases, the output voltage and current raise and cause the resisting force to match the user's maximum capacity. As a result, the motion speed is limited by the user's strength. By changing the electrical resistive load, the user can change the speed limit of his motion.

The isokinetic exercise equipments which utilize hydraulic cylinder and electric generator as means for generating resistance suffer a major draw-back: lack of resistance at the beginning and the end of each motion. The resistance generated by these devices increases with increasing speed of motion; therefore, at the beginning and the end of each exercise repetition where the motion speed is minimal, the resistance is virtually diminished. As a result, the exercise motion does not have the pre-stretch and full range resistance which are necessary for an effective strength training. The present invention provides a solution for the above short-coming.

SUMMARY OF THE INVENTION AND OBJECTS

The object of this invention is to provide a new design concept and principle for strength training exercise equipments which assist the user to obtain isokinetic training without lacking of pre-stretch and full range resistance.

The apparatus utilizing the basic principle of this invention provides the user with a resistance that increase with increasing motion speed when the motion speed exceeds the pre-selected setting; below that speed, the resistance remains at a controllable minimum level. This design concept ensures a minimum resistance throughout the range of motion.

DESCRIPTION OF THE PREFERRED EMBODIMENT

A physical exercise apparatus basically comprises of three major parts: a resistance generator for providing resistance to the user; a user input means for transferring the resistance from the resistance generator to the user; and structural frames for supporting all components. There are many concepts and approaches for designing the user input means and frames, but these areas are not in the main context of this invention. This invention concentrates on the resistance generator.

Figure 1:
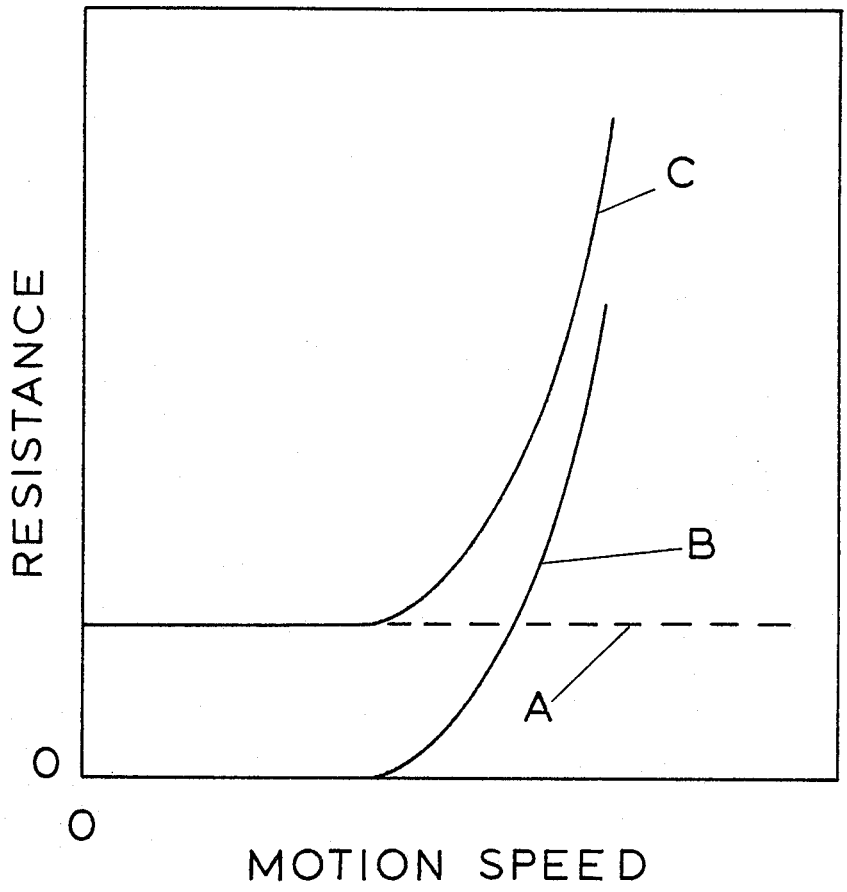
FIG. 1 is a graph showing the responses of resistances to motion speed provided by the resistance generator of the present invention.

Referring now to FIG. 1, curve C represents the output resistance generated by the resistance generator employing the basic concept of this invention, said output resistance is the sum of two resistance components:

Isokinetic (constant speed) component represented by curve B increases with increasing motion speed when the motion speed exceeds a preselected setting, below said pre-selected speed this component is minimal;

Isotonic component (constant force) represented by curve A is unaffected by the motion speed and remains at a preselected level.

To obtain such resistance output, the resistance generator includes in combination an isokinetic resistance means and an isotonic resistance means. It is possible to utilize a resistance generating means that can provide both types of resistance simultaneously, this approach may have an economical advantage.

Figure 2:
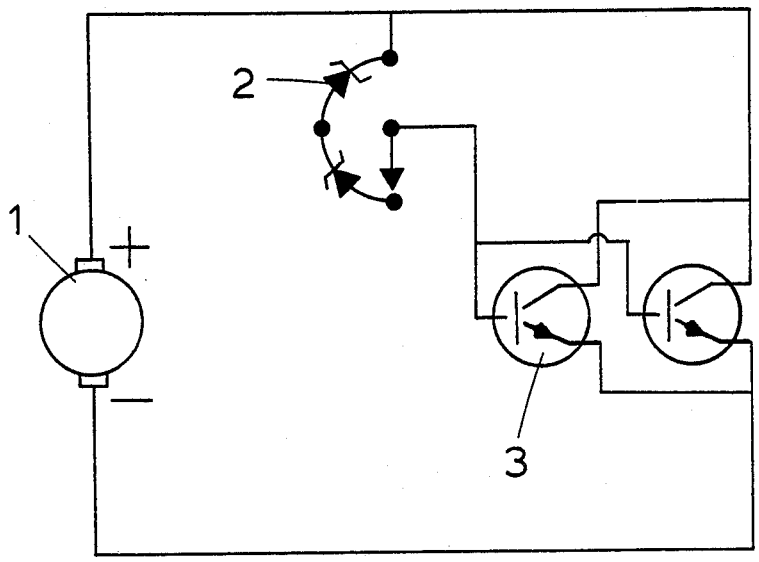
FIG. 2 is a schematic partial illustration of an electrical braking circuit for governing the rotation speed of an electric generator.

The isokinetic resistance means can be dashpot referred by some manufacturers as shock absorber or damper. The dashpot generates resistance by having its output member which is connected to the user input means moved in a viscous medium such as oil; one commonly used type of dashpot is hydraulic cylinder. An electric generator having an electrical loading means with variable and controllable conductivity connected across its two output terminals is another alternative for generating isokinetic resistance. As illustrated in FIG. 2, the electrical loading means 3 is a set of power transistors with collectors and emitters connected to the two terminals of the generator 1. A zener diode network 2 with variable zener potential has its cathode and anode connected to collectors and bases of the transistors respectively. An electrical current starts to flow through the circuit when the voltage across the generator 1 exceeds the zener potential and generates a resistance that increases with increasing motion speed. As a result, the zener potential determines the speed of the isokinetic motion.

Figure 3:
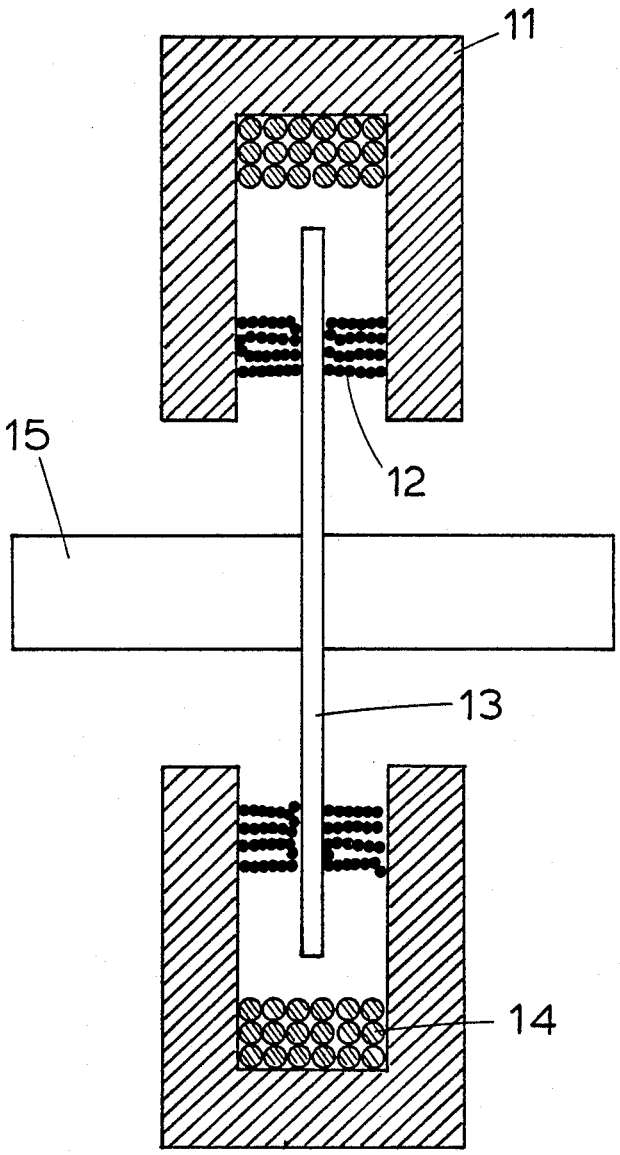
FIG. 3 is a schematic partial illustration of a cross sectional view of an magnetic particle brake.

The isotonic resistance means can be commonly used weight stacks or magnetic particle brake (produced by Waner Electric Brake & Clutch Company and Electroid Co.). As illustrated in FIG. 3, flux lines of surrounding electromagnet 11 form magnetic particle chains 12 in ferrous powder to create resistance to rotation of the inner disc 13 mounted on an output shaft 15. The resistance generated by this type of magnetic particle brake is independent of motion speed and is directly proportional to electrical current input applied to the electromagnetic winding 14. To utilize the magnetic particle brake for generating isotonic resistance, the input current is kept at a preselected level.

Figure 4:
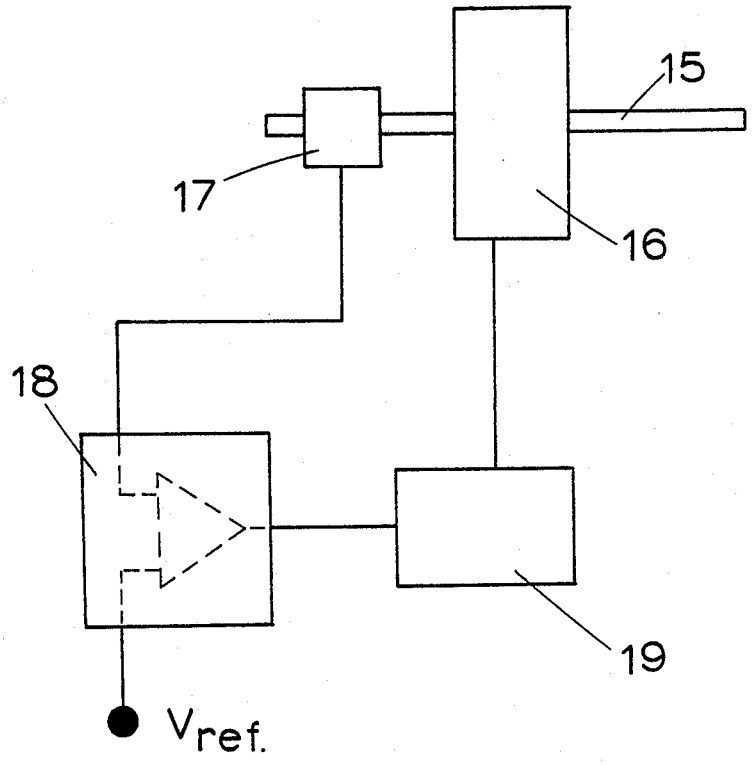
FIG. 4 is a schematic partial illustration of a control system for governing the resistance output of a magnetic particle brake which provides isokinetic resistance.

The magnetic particle brake can also be used as an isokinetic resistance means. FIG. 4 illustrates a control system for governing the resistance output of a magnetic particle brake 16 which provides an isokinetic resistance. This control system comprises:

a power supply means 19 with variable and controllable output supplying an electrical current to the brake electromagnet winding;

a speed detecting means 17 connected to the brake output shaft for detecting the motion speed;

an isokinetic controller 18 connected to the power supply means 19 for controlling the power supply current output, the isokinetic controller 18 compares the output signal from the speed detecting means 17 with a predetermined isokinetic speed setting and causes the power supply 19 means to generate no electrical current output when the motion speed is below said isokinetic speed setting and an electrical current that increases with increasing motion speed when the speed exceeds said isokinetic speed setting; the speed detecting means 17 may be a tachometer-generator and the isokinetic controller 18 may comprise a voltage comparing means for comparing the output signal from said voltage comparing means for comparing the output signal from said generator 17 with a reference voltage ( Vref.) which determines the isokinetic speed setting.

It becomes apparent that the magnetic particle brake can be utilized to generate both isotonic and isokinetic resistances simultaneously. This can be accomplished by adding an isotonic controlling means to the power supply means 19, said isotonic controlling means causes the power supply means 19 to maintain the current output above a pre-selected level; the output resistance becomes the sum of two components: isotonic resistance caused by said isotonic controlling means and isokinetic resistance caused by the isokinetic controller 18.

Figure 5:
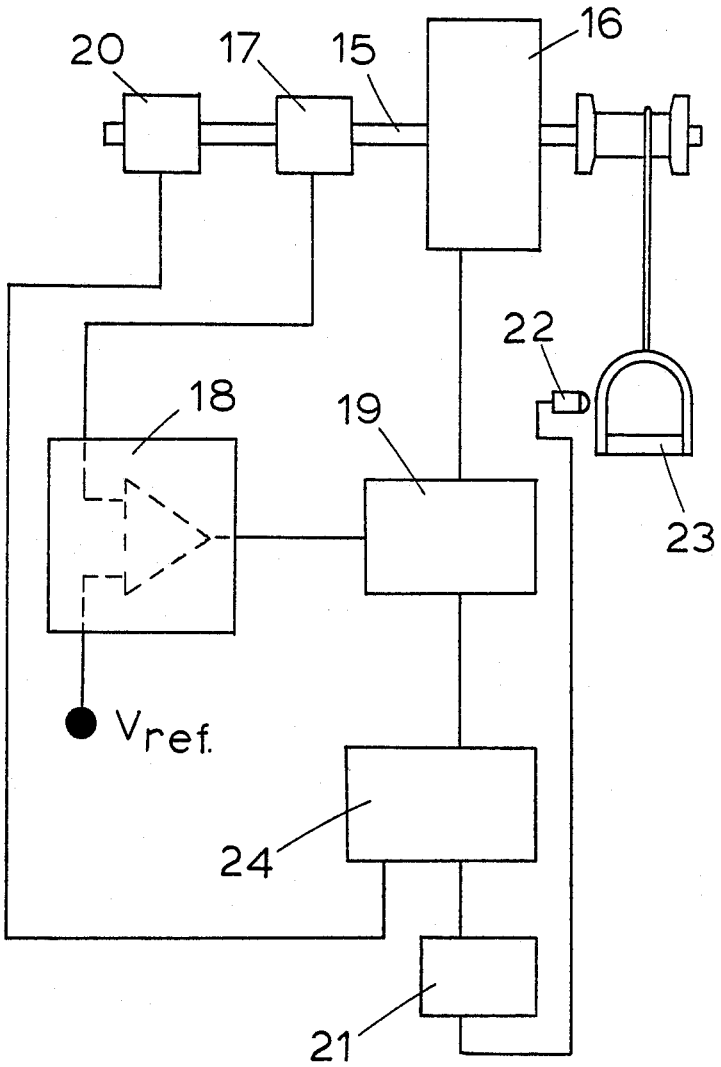
FIG. 5 is a schematic partial illustration of a control system for governing the resistance output of a magnetic particle brake which provides both isokinetic and isotonic resistances simultaneously; wherein the isotonic component follows an optimum strength curve for the user in training and for a particular exercise.

Since the muscle strength is not uniform throughout the range of motion, it varies with position. For example, during leg extension exercise, the leg is weaker at the most extended position. Therefore, for optimum training, the isotonic component should vary with position within the range of motion and follow an optimum strength curve for each exercise routing. Another adjustment for the isotonic resistance can be taken into consideration: due to muscle fatigue, the user's maximum strength decreases with subsequent repetition during training; therefore, the magnitude of the isotonic strength curve should be lowered accordingly after each repetition. FIG. 5 illustrates a control system for governing the resistance output of a magnetic particle brake which provides both isokinetic and isotonic resistances simultaneously; wherein the isotonic component follows an optimum strength curve for the use in training and for a particular exercise; said strength curve is adjusted after each repetition to compensate for muscle fatigue. This control system comprises:

a power supply means 19 with variable and controllable output supplying an electrical current to the brake electromagnet winding;

a speed detecting means 17 connected to the brake output shaft for detecting the motion speed;

an isokinetic controller 18 connected to the power supply means 19 for controlling the power supply current output, the isokinetic controller 18 compares the output signal from the speed detecting means 17 with a predetermined isokinetic speed setting and causes the power supply 19 means to generate no electrical current output when the motion speed is below said isokinetic speed setting and an electrical current that increases with increasing motion speed when the speed exceeds said isokinetic speed setting; the speed detecting means 17 may be a tachometer-generator and the isokinetic controller 18 may comprise a voltage comparing means for comparing the output signal from said generator with a reference voltage ( Vref.) which determines the isokinetic speed setting;

a position detecting means 20 such as a potential meter or digital encoder connected to the brake output shaft for detecting the position of the motion;

a counting means for counting the number of repetition being completed by the user; said counting means may comprise a digital counter 21 connected to a sensor 22 which detects the present of the user input means 23 when it passes through the location where the sensor 22 is mounted;

an isotonic controller 24 connected to the power supply means 19 for controlling the power supply output current, the isotonic controller 24 receives the information from the position detecting means 20 and the counter 21, processes said information with a built in programable microprocessor and sends command signals to the power supply means 19, said isotonic controller 24 causes the brake to generates an isotonic resistance that follows an optimum strength curve for each specific exercise motion; The magnitude of said strength curve depends on the maximum strength of the specific user in training and the number of repetition being completed by the user; wherein the total output resistance is the sum of resistances caused by the isokinetic controller 18 and the isotonic controller 24.

Figure 6:
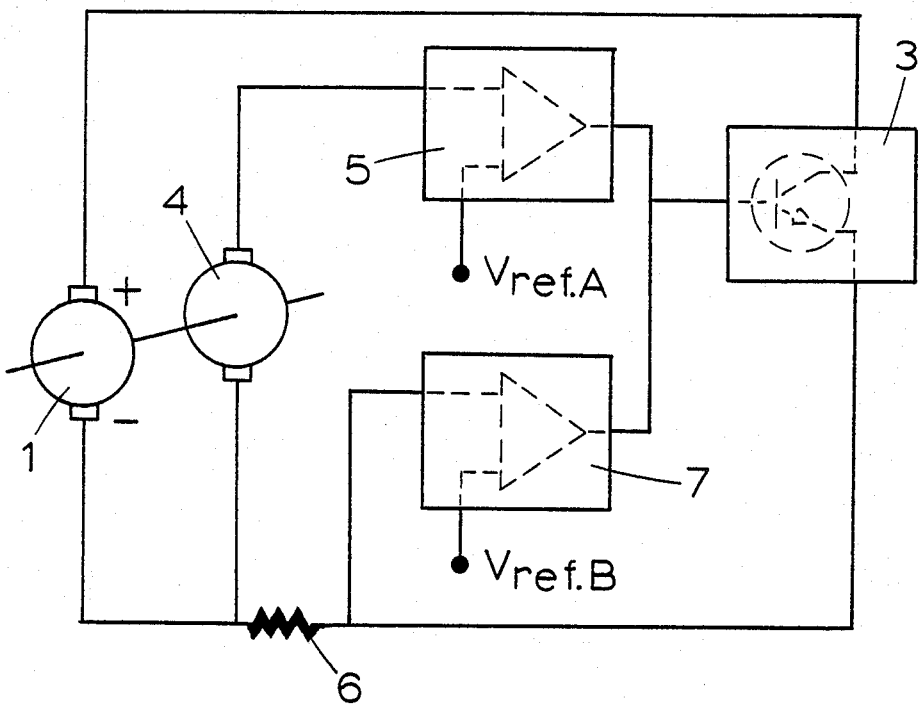
FIG. 6 is a schematic partial illustration of an electrical braking circuit for governing the resisting torque and rotation speed of an electric generator.
Figure 7:
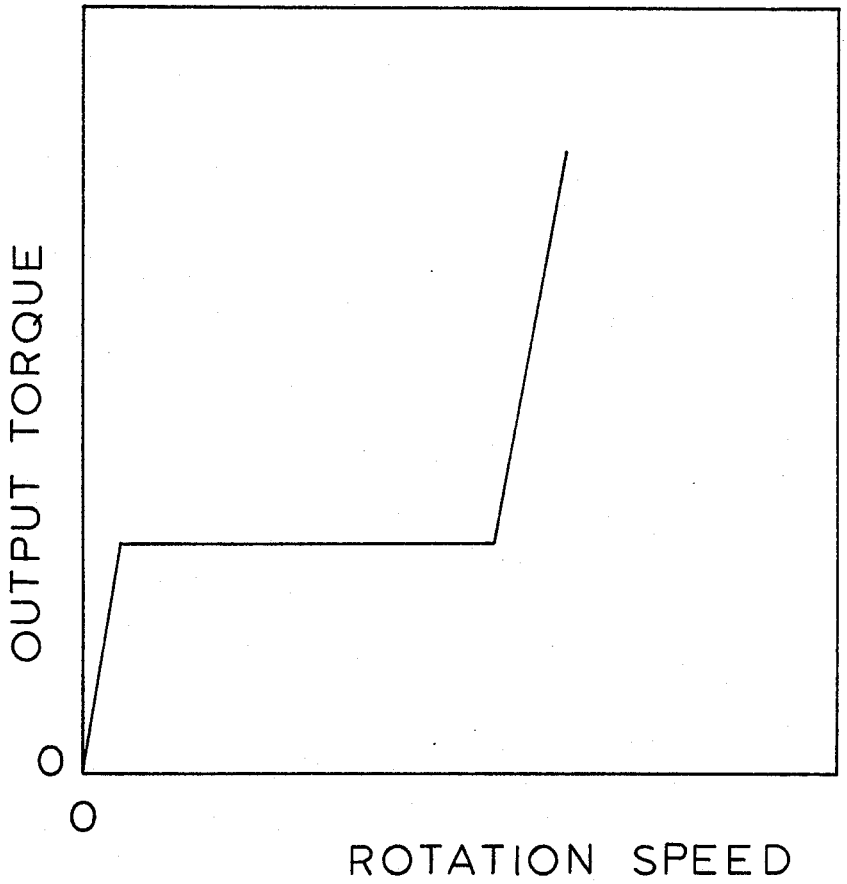
FIG. 7 is a graph showing the responses of resisting torque to rotation speed of an electric generator governed by the braking circuit illustrated in FIG. 6.

A combination of isokinetic and isotonic resistances can be achieved with an electric generator having a simple control system illustrated in FIG. 6. Said control system comprises:

an electrical loading means 3 with variable and controllable conductivity connected to the output terminals of the generator 1, the loading means 3 can be set of power transistors;

a speed detecting means 4 connected to the generator output shaft for detecting the generator speed, it can be a tachometer-generator or a digital encoder; the voltage across the generator 1 output terminals can also be used to determine the generator speed, this approach is implemented in the design illustrated in FIG. 2;

a speed comparing means 5 which may comprise a voltage comparator comparing the output voltage from the speed detecting means with a reference voltage A ( Vref.A ), the speed comparing means is connected to the control input of the electrical loading means 3 and causes the electrical loading means to increase conductivity when the generator 1 speed exceeds a pre-selected speed setting determined by the reference voltage A and to remain at the least conductive state when the speed falls below said preselected speed;

a torque detecting means which can be a current sensing resistor 6 connected between the electrical loading means 3 and a generator 1 output terminal; since the electrical current flowing through the generator 1 increases proportionally with the generated torque, the voltage across the current sensing resistor 6 determines said generated torque;

a torque comparing means 7 which may comprise a voltage comparator comparing the voltage across the current sensing means with a reference voltage B ( Vref.B ), the torque comparing means 7 is connected to the control input of the electrical loading means 3 and causes the electrical loading means to decrease conductivity when the generator torque exceeds a pre-selected toque setting determined by the reference voltage B and to remain at the most conductive state when the generator torque falls below the preselected torque; with such arrangement, the conductivity of the electrical loading means 3 is a function of the sum of conductivity caused by the speed comparing means 5 and the torque comparing means 7; the output torque of the generator governed by this control system can be illustrated in FIG. 7; wherein the output torque has a steep increase with increasing speed when the torque is below a preselected value and when the speed exceeds a preset level.

Figure 8:
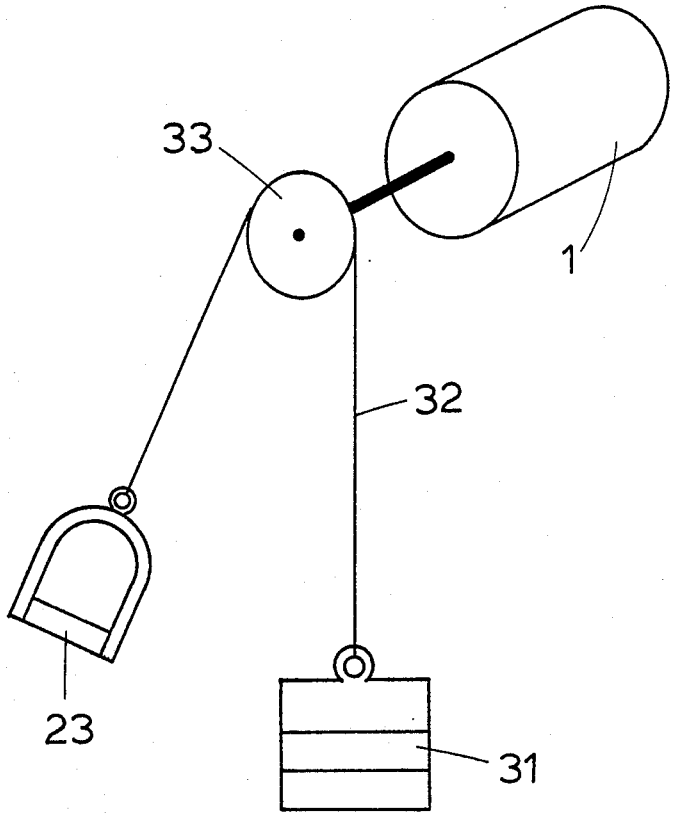
FIG. 8 is a schematic partial illustration of an exercise apparatus which utilizes an electric generator as isokinetic resistance means and a weight stack as isotonic resistance means.

FIG. 8 partially illustrates an exercise apparatus which utilizes an electric generator 1 having a controller illustrated in FIG. 2 and a weight stack 31 as means for generating resistances. This apparatus comprises a chain 32 with one end attached to a user input means 23 and with the other end attached to the weight stack 31; the chain 32 wraps around a sprocket 33 mounted on the generator shaft; as the user pulls on the user input means 23, the chain 32 moves and rotates the generator 1 while lifting the weight stack 31. The resistance experienced by the user is the sum of the isokinetic resistance provided the generator 1 and the isotonic resistance provided by the weight stack 31.

Having described and disclosed my invention, I claim:

1. A physical exercise apparatus having a resistance generator for generating physical exercise resistance comprising:

a magnetic particle brake having the electromagnet windings for generating resistance for said physical exercise apparatus;

a power supply means for supplying an variable electrical current output to said electromagnet windings;

a speed detecting means for detecting a motion speed generated by said magnetic particle brake and outputting a detected signal;

an isotonic resistance controlling means connected to said power supply means for maintaining said electrical current output above a preselected current level;

an isokinetic resistance controlling means connected to said power supply means for controlling said electrical current; said isokinetic controlling means including means for comparing said detected signal with a preselected isokinetic speed setting, and for causing said power supply means (a) to generate no electrical current output when said motion speed is below said isokinetic speed setting or (b) to generate an electrical current output that increases with increasing said motion speed when said motion speed exceeds said isokinetic speed setting; and wherein said electrical current from said power supply means is the sum the current outputs controlled by said isotonic controlling means and said isokinetic controlling means.

2. A physical exercise apparatus having a resistance generator for generating physical exercise resistance comprising:

a magnetic particle brake having the electromagnet windings for generating resistance for said physical exercise apparatus;

a power supply means for supplying variable electrical current output to said electromagnet windings;

a speed detecting means for detecting a motion speed generated by said magnetic particle brake and outputting a detected motion speed signal;

an isokinetic controlling means connected to said power supply means for controlling sais electrical current; said isokinetic controlling means including means for comparing said detected motion speed signal with a preselected isokinetic speed setting and causing said power supply means (a) to generate no electrical current output when said motion speed is below said isokinetic speed setting or (b) to generate an electrical current output that increasing said motion speed when said detected motion speed exceeds said isokinetic speed setting;

a position detecting means for detecting a motion position generated by said magnetic particle brake and outputting a detected motion position signal;

a counter mens for counting a number of repetition being completed by a user from said physical exercise apparatus and outputting a count signal;

an isotonic controlling means connected to said power supply means for controlling said electrical current output; said isotonic controlling means including a programable microprocessor for processing said detected motion position signal and said count signal and generating a controlling signal to said power supply means to control said electrical current output; said isotonic controlling means causes said magnetic particle brake to generate an isotonic resistance that follows an optimum strength curve for each specific exercise motion; the magnitude of said strength curve depends on a maximum strength of said user and said number of repetition being completed by said user; and wherein a total output resistance is the sum of said resistances caused by said isokinetic controlling means and said isotonic controlling means.

3. A physical exercise apparatus having a resistance generator for providing physical exercise resistance comprising:

an electric generator;

an electrical loading means for supplying variable and controllable conductivity to a output terminal of an electric generator;

a speed control feedback means connected to said electrical loading means for controlling said variable and controllable conductivity; said speed feedback means comprises means for detecting a generator speed generated by said electric generator and speed comparing means for comparing said detected generator speed with a predetermined speed setting; said speed comparing means causes said electrical loading means (a) to increase said conductivity when said generator speed exceeds said predetermined speed setting or (b) to generate said said conductive at a least conductive state when said generator speed is below said predetermined speed setting;

a torque control feedback means connected to said electrical loading means for controlling said variable and controllable conductivity; said torque control feedback means including means for detecting resisting torque generated by said electric generator and torque comparing means for comparing said detected resisting torque with a predetermined torque setting; said torque comparing means causing said electrical loading means (a) to decrease said conductivity when said detected resisting torque exceeds said predetermined torque setting or (b) to generate said conductivity at a most conductive state when said detected resisting torque is below said predetermined torque setting; and wherein said conductivity is a function of the sum of said conductivities caused by said speed control feedback means and said torque control feedback means

* * * * *